US005355943A

United States Patent [19]

Gonano et al.

[11] Patent Number: 5,355,943

[45] Date of Patent: Oct. 18, 1994

[54] VACUUM STEAM CONDENSING PLANTS USING AIR AS THE COOLING FLUID

[75] Inventors: Giuseppe Gonano, Monza; Giovanni Murgia, Milan; Giovanni Ricci, Bergamo, all of Italy

[73] Assignee: FBM Hudson Italiana S.p.A., Milan, Italy

[21] Appl. No.: 4,419

[22] Filed: Jan. 14, 1993

[30] Foreign Application Priority Data

Jan. 17, 1992 [IT] Italy ..... MI 92 A 000086

[51] Int. Cl.[5] ..... F28B 1/06

[52] U.S. Cl. ..... 165/112; 165/113; 165/115

[58] Field of Search ..... 165/112, 114, 111, 115, 165/118

[56] References Cited

U.S. PATENT DOCUMENTS

| | | | |
|---|---|---|---|
| 1,962,183 | 6/1934 | Ehrhart | 165/112 |
| 3,705,621 | 12/1972 | Schoonman | 165/112 |
| 3,968,836 | 7/1976 | Larinoff | 165/111 |
| 4,240,502 | 12/1980 | Larinoff | 165/112 |
| 4,537,248 | 8/1985 | Minami . | |

FOREIGN PATENT DOCUMENTS

| | | |
|---|---|---|
| 1082606 | 6/1960 | Fed. Rep. of Germany . |
| 978067 | 3/1963 | United Kingdom . |
| 2017894 | 10/1978 | United Kingdom . |

*Primary Examiner*—Albert W. Davis, Jr.
*Attorney, Agent, or Firm*—Shlesinger Fitzsimmons Shlesinger

[57] ABSTRACT

A condensing plant (10) comprises a steam receiving inlet manifold (11) connected to one end of tube nests (14) externally grazed by air for therein achieving the at least partial steam condensation. At their opposite end the tubes (14) are gathered into at least one outlet manifold (15) for the condensed liquid. Each outlet manifold (15) is connected by a vertically-extending duct (17) to a vertical rain-fall element (19, 20) opening at the lower part thereof into a collection tank (21). The collection tank (21) is supplied with steam from the inlet manifold (11) so that said steam moves up along the vertical element (20) for heating of the liquid falling thereinto.

9 Claims, 2 Drawing Sheets

VACUUM STEAM CONDENSING PLANTS USING AIR AS THE COOLING FLUID

The present invention relates to condensing plants using ambient air as the cooling fluid, in particular for processing steam discharged from a turbine in energy generating plants, in which the condensate is sent again to the boiler for a new steam generation.

In the known art these plants are embodied by condensers consisting of tube nests disposed in superposed layers, to which steam is admitted and which are externally grazed by cooling air streams.

Since air passes through the different layers of the tube nests in succession, it becomes increasingly hotter and consequently the amount of condensed steam decreases with the increase of the layers passed through by said air. Thus pressure drops are correspondingly lower in the successive layers of a tube nest.

A phenomenon connected with such pressure differences encountered in steam condensing in the different layers of the heat exchange tubes is that of the condensate subcooling. In fact, the condensate coming out of the tubes is of a lower temperature than the saturation temperature at the turbine discharge pressure. In addition this temperature decreases from the last layer to the first one, that is the greater the difference between the turbine discharge pressure and the pressure in the outlet manifold of the individual layer is, the lower said temperature is.

The foregoing involves an energy degradation and therefore a loss in the thermodynamic efficiency of the whole thermal cycle, keeping into account the fact that the condensate needs to be heated again (starting from a lower thermal level than the one which is theoretically necessary) until the steam state is reached for the following passage to the turbine. The main object of the present invention is to eliminate the above described drawbacks by providing a plant in which subcooling of the condensate to be sent back to the cycle and the boiler is restricted.

Another problem resulting from the above pressure differences is represented by the possible establishment of a steam circulation so that steam coming out of the last layers can be sucked in countercurrent into the first layers. Obviously such a situation is to be avoided because it can lead to the formation of incondensable gas pockets that in addition to further reducing efficiency, give rise to localised corrosion phenomena and, in case of operation in rigorous climates, to risks of ice formation.

It is a further object of the invention to provide an efficient solution capable of preventing the gasous tops of the outlet manifolds for the different condensation tube layers from being brought into communication with one another. For the achievement of the above object, in accordance with the invention a condensing plant has been devised which comprises a steam receiving inlet manifold which is connected to one end of tube nests externally grazed by air for therein achieving the at least partial steam condensation, said tubes at the opposite end thereof being gathered in at least one outlet manifold for the condensed liquid which is connected by a vertically-extending duct to a vertical rainfall element opening at the lower part thereof into a collection tank supplied with steam from the inlet manifold, which steam moves up along said vertical element for heating of the falling liquid.

For a clearer explanation of the innovative principles of the present invention and for the purpose of showing the advantages thereof as compared to the known art, possible embodiments putting into practice the above principles are given hereinafter, by way of example only, with the aid of the accompanying drawings, in which.

Figure 1:
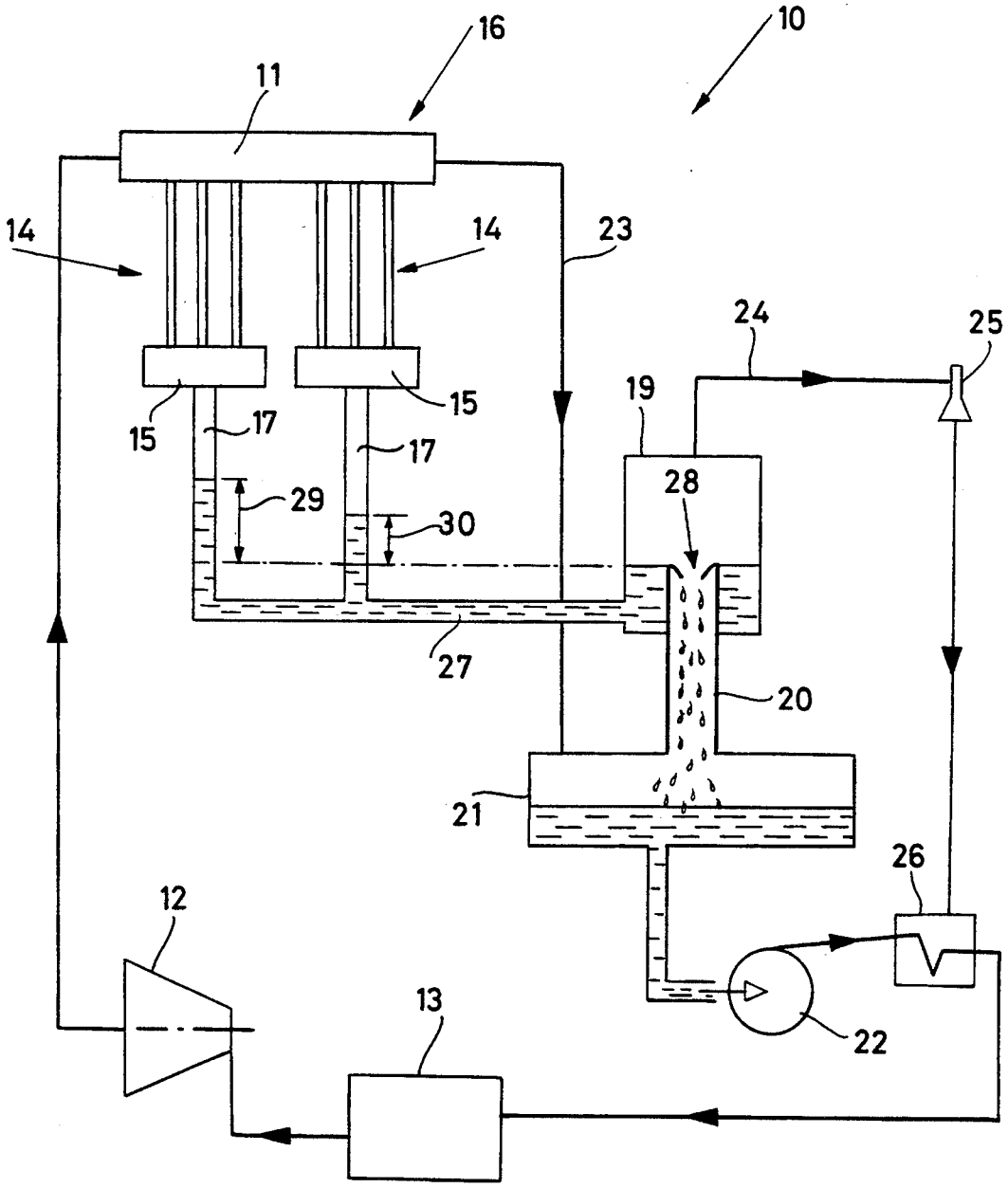
FIG. 1 is a diagrammatic view of a first steam condensing plant embodying the innovative principles of the invention.

Referring to the drawings, shown in FIG. 1 is a first embodiment of the invention involving a plant 10 provided with air condensers 16 receiving at an inlet manifold 11 thereof, steam coming out of a turbine 12 fed by a boiler 13. The condensers 16 comprise superposed tube nests 14 (for the sake of simplicity said tube nests are shown in side by side relation and in the number of two), each tube layer opening into separate outlet manifolds 15. Each outlet manifold 15 is connected through a respective duct 17 extending vertically downwardly, to the bottom of a vessel or fluid-tight chamber 19. Another vertical duct 20 connects the vessel 19, through the bottom thereof, to a condensate collecting tank 21 located below. The tank 21 is connected at the lower part thereof to a suction pump 22 sending the condensate again to the boiler 13 for a new vaporization and therefore the beginning of a new cycle.

A duct 23 brings the manifold 11 into communication with the top of the tank 21 so that part of the steam coming from the turbine 12 is admitted thereto. Provided over the vessel 19 is a duct 24 that, through an ejector 25, sends gases present in the vessel top to a condenser 26 passed through by the condensate flow coming from the pump 22 and directed to the boiler 13.

The upper end of the duct 20 which is inside the vessel 19, has its mouthpiece at a greater height than the admission height of the ducts 17 to said vessel, said ducts 17 being possibly gathered, as shown in FIG. 1, into a single duct 27. In addition, said mouthpiece may be comprised of appropriate baffles 28 (consisting of mere metal plates for example oriented towards the tube axis) for a purpose to be clarified below.

Operation of a plant as above described is as follows. Steam from the turbine 12 is sent to the condensers 16 so that it recondenses into water which, through manifolds 15 and tubes 17, 27 is sent to vessel 19.

Pressure in the vessel 19, due to the connection supplied by ducts 20 and 23, is equal to the pressure of steam entering the condenser, which pressure is higher than that present in the outlet manifolds 15. Therefore, in the ducts 17 there will be the formation, with respect to the liquid surface in vessel 19, of water heads 29 and 30 (the height of which will depend on the pressure in the different manifolds 15) and consequently hydraulic stoppers will be formed that will prevent gas and steam present at different pressures in the individual manifolds 15 from mixing together.

The liquid discharged into the vessel 19, as it reaches the mouthpiece of the duct 20, overflows and, by virtue of baffles 28, is rain-like spread falling into the duct 20 which is large enough to enable steam passage in countercurrent, which steam admitted thereto from the duct 23 goes up along the tube 20 and is sucked by the duct 24 on top of vessel 19.

In this way, the liquid passing from vessel 19 to tank 21 is heated in a very efficient manner by steam in countercurrent which also partly condenses. The uncondensed steam portion together with the gases that may be present, is sucked through the duct 24 and ejector 25. This ejector is normally driven by steam under pressure of a conveniently higher value than that of the pressure present on suction. This actuating steam is condensed together with the steam sucked from vessel 19 into the condenser 26 and therefore the liquid directed to the boiler is further heated.

Thus the decay of efficiency of the whole cycle due to subcooling in the condenser is restricted. At the same time a perfect hydraulic block is established which prevents steam from circulating between the different outlet manifolds to different pressures.

Obviously the plant as diagrammatically described and shown in FIG. 1 is reproduced for the purpose of offering better understanding of the innovative principles of the present invention. For the above reasons elements belonging to the known art and easily conceivable by a person having normal skill in the field have been omitted.

For example, condenser 16 will be provided with known devices for drawing off uncondensed and incondensable fluids to be processed separately.

Figure 2:
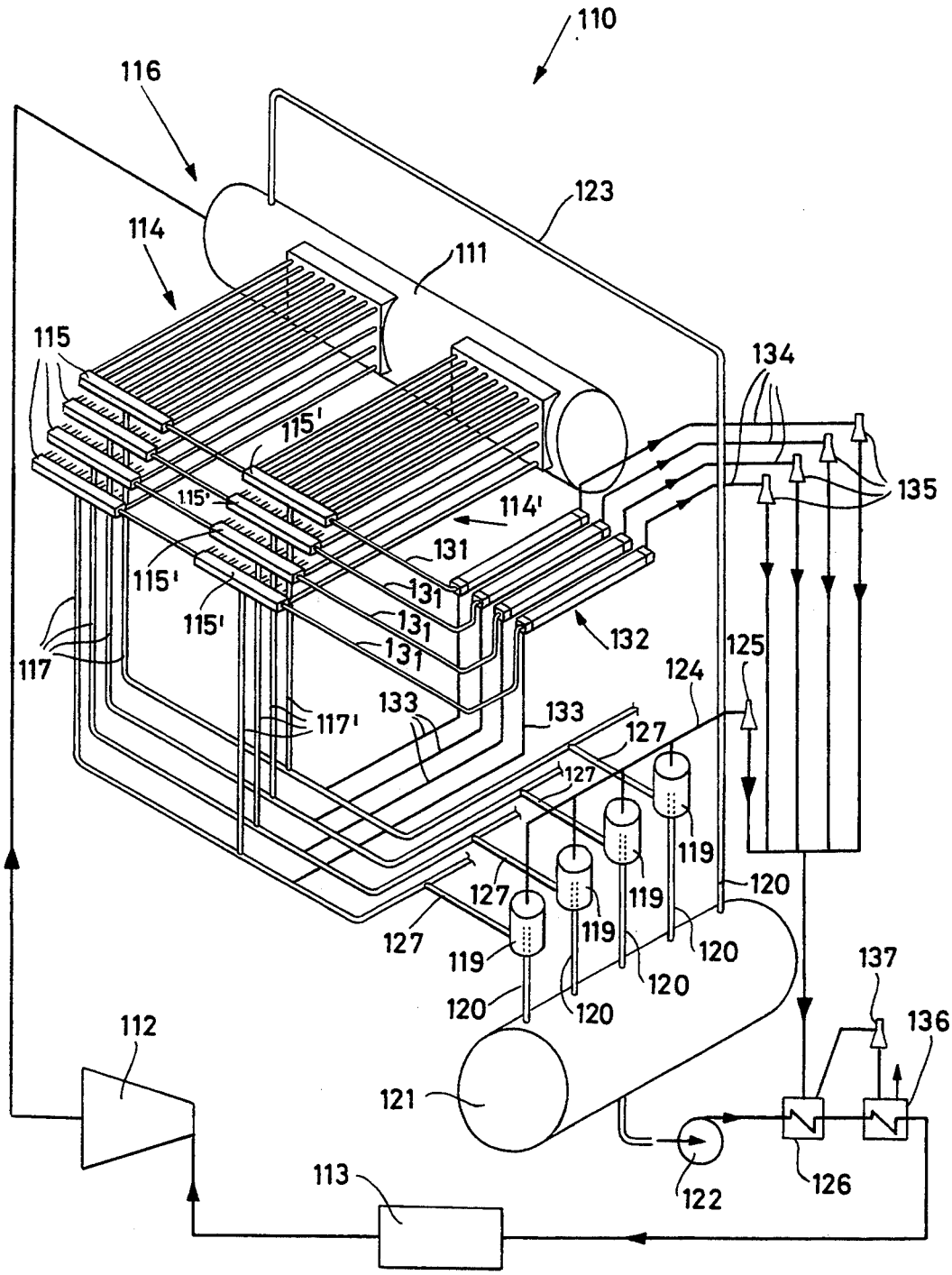
FIG. 2 is a diagrammatic view of a second steam condensing plant embodying the innovative principles of the invention.

For better explaining the innovative principles herein claimed, a further condensing plant putting said principles into practice has been shown in FIG. 2.

Operatively similar elements in the plants of FIG. 1 and FIG. 2 will be allocated in FIG. 2 the same reference numerals as in FIG. 1 but increased by one hundred.

Referring to FIG. 2, a plant 110 comprises air condensers 116 receiving at an inlet manifold 111 thereof, steam coming for example from a turbine 112 fed from a boiler 113.

The condensers 116 are comprised of separate superposed tube nests forming layers. In the figure the different layers are divided into groups 114, 114'. Each tube layer of each group opens into separate outlet manifolds 115. 115'.

As can be easily understood from a person skilled in the art, the number of the groups or nests may be whatever, by suitably lengthening the inlet manifold 111. Groups disposed symmetrically to the manifold 111 may also be provided, so as to form an inverted V for example, which has the manifold 111 at the upper vertex thereof.

Each outlet manifold 115, 115' is connected to a respective duct extending vertically downwardly 117, 117'. Layers at the same position in the different tube nests have ducts 117, 117' connected together so as to be gathered into one and the same connecting duct 127 at the bottom of their own vessel or fluid-tight chamber 119. Another vertical duct 120 connects each vessel 119, through the bottom thereof, to a single tank 121 located below, for collection of all condensates. Tank 121 is connected at the lower part thereof to a suction pump 122 sending the condensate again to the boiler 113 so that it is vaporized again and a new cycle can begin.

A duct 123 brings the manifold 111 into communication with the top of the tank 121 so that part of the steam coming from the turbine 112 is admitted thereto.

All vessels 119 are connected at the upper part thereof to a duct 124 that, through an ejector 125, sends the gases present in the vessel 119 tops to a condenser 126 passed through by the condensate flow coming from the pump 122 and directed to the boiler 113.

Each vessel 119 is made, together with its own pipe 120, in the same manner as described in the embodiment of FIG. 1 and therefore its operation as a hydraulic stopper and heater and rain condenser is as described with reference to FIG. 1.

Each vessel 119 however receives liquids coming from layers located at a well precise position in the different nests. These liquids will be then condensed in the different nests to the same conditions and therefore will have the same temperatures (apart from marginal tolerances between the nests).

Possibly, by conveniently lengthening the duct 120 processing the water coming from the lower layers, temperatures in the different waters can be made equal before mixing them in the tank 121. In the plant shown in FIG. 2 also a circuit is represented for disposal of uncondensed and incondensable fluids that accumulate in the manifolds 115, 115'.

The above circuit is provided with ducts 131 drawing off uncondensed gas and steam from the manifolds 115, 115'. Obviously connection between manifolds having different pressures must be avoided. Therefore each duct 131 will interconnect only the manifolds belonging to layers having the same position in the nests.

Each duct 131 will route gases and steam to a respective vent precondenser 132. Ducts 133 will send to the ducts 127 all that has condensed in the precondenser 132, whereas ducts 134, through ejectors 135, will bring the uncondensed fluids to the condenser 126. Unlike FIG. 1, in FIG. 2 in addition to a first condenser 126, also a second condenser 136 is shown which is connected to the first condenser through an ejector 137. The presence of two condensers is in accordance with the known art providing that gas compression from the vacuum present in the condenser to the atmospheric pressure should occur in two stages, for the purpose of optimizing the yield. It can be easily seen that in vertical ducts 117, 117' and in the vertical lengths of ducts 133 water columns will be formed that constitute an excellent hydraulic stopper preventing any possibilities of gas or steam passage between the manifolds belonging to layers having different positions in the nests. At this point it is clear that the intended purposes of achieving a separation between the different layers having different pressures and avoiding an excessive subcooling of the condensed liquid sent back to the boiler have been attained.

Obviously, the above description of embodiments putting into practice the innovative principles of the present invention is given by way of example only and therefore must not be considered as a limitation of the scope of the invention as herein claimed.

For example, the number of nests, layers for each nest, and tubes for each layer may be whatever, being obvious that the connections as shown in FIGS. 1 and 2 will be conveniently extended.

In addition, in the plants shown, also known elements (such as fans and related driving members) for enabling the forced circulation of the cooling air through the condensers formed with finned tubes will be present, as well as control and safety devices, preprocessing devices for the liquid to be sent to the boiler, etc.

Obviously a person having normal skill in the art will be able to conceive plant solutions combining the features of the plant shown in FIG. 1 with those of the plant shown in FIG. 2. For example, it is possible to use a vessel 19, 119 every two, three or more superposed layers, so as to reduce the number of vessels 19, 119 necessary in case of nests having a great number of layers through the accomplishment of a hybrid structure staying in the middle between the case in which only one vessel for all layers is provided (FIG. 1) and the case in which a vessel is provided for each layer (FIG. 2). Optionally two or more vessels for each layer are also possible. Finally, while a condensing plant applied to a turbine has been described by way of example, it is understood that the condensing plants of the invention can be used in other different fields.

We claim:

1. A condensing plant comprising a steam receiving inlet manifold connected to one end of tube nests externally grazed by air for therein achieving the at least partial steam condensation, said tubes at the opposite ends thereof being gathered in at least one outlet manifold for the condensed liquid which is connected by a vertically-extending duct to a vertical rain-fall element opening at the lower part thereof into a collection tank supplied with steam from the inlet manifold, which steam moves up along said vertical element for heating of the falling liquid, said vertical rain-fall element at the upper part thereof comprising a chamber or vessel inside of which a vertical rain-fall duct opening into the collection tank projects from the bottom, the upper end of said vertical duct being at a higher level than the level of the liquid entering the vessel from the outlet manifold so as to form a liquid storage on the vessel bottom of the surface of said liquid grazing said upper end of the vertical duct.

2. A plant according to claim 1, characterized in that the upper end of the vertical duct comprises means for rain spreading at the inside of the duct, the liquid grazing said upper end.

3. A plant according to claim 1, characterized in that the chamber or vessel is provided at the upper part thereof with a discharge duct for the steam moving up along the vertical duct and the residual gas and uncondensed steam.

4. A plant according to claim 3, characterized in that the discharge duct brings steam and gases to a condenser cooled by a liquid flow coming out of the tank.

5. A plant according to claim 1, characterized in that the vertically-extending duct routing the liquid from the outlet manifold to the chamber comprises a downwardly extending length the upper end of which is located at a higher level than the vertical rain-fall duct, the difference in levels being at least sufficient to compensate for the liquid raising in the vertically extending duct caused by the difference in pressure between the chamber and the outlet manifold, thereby creating a hydraulic stopper between the chamber and the outlet manifolds.

6. A plant according to claim 1, characterized in that the tube nests are gathered in superposed layers and in that at least one rain-fall element is provided for each layer.

7. A plant according to claim 6, characterized in that all vertical rain-fall elements are connected at the lower part thereof to one and the same collection tank.

8. A plant according to claim 1, characterized in that the outlet manifolds comprise means for drawing the uncondensed fluids therefrom and sending said uncondensed fluids to other condensers from which the condensed liquids are sent to the rain-fall elements.

9. A plant according to claim 6, characterized in that each layer is divided into groups of tubes, each group having its own outlet manifold.

* * * * *